US005540337A

United States Patent [19]

Riggs et al.

[11] Patent Number: 5,540,337

[45] Date of Patent: Jul. 30, 1996

[54] ALKYLOXYALKANEAMINES USEFUL AS CATIONIC FROTH FLOTATION COLLECTORS

[75] Inventors: William F. Riggs; Carlos Andress, both of Humble, Tex.

[73] Assignee: Baker Hughes Incorporated, Houston, Tex.

[21] Appl. No.: 222,744

[22] Filed: Apr. 4, 1994

[51] Int. Cl.[6] ..... B03D 1/02; B03D 1/01

[52] U.S. Cl. ..... 209/166; 252/61

[58] Field of Search ..... 209/166, 167; 252/61

[56] References Cited

U.S. PATENT DOCUMENTS

| | | | |
|---|---|---|---|
| 3,076,819 | 2/1963 | Heise . | |
| 3,363,758 | 1/1968 | Cronberg, et al. | 209/166 |
| 3,744,629 | 7/1973 | Baarson et al. | 209/166 |
| 4,319,987 | 3/1982 | Shaw et al. | 209/166 |

FOREIGN PATENT DOCUMENTS

| | | |
|---|---|---|
| 0796803 | 10/1968 | Canada . |
| 0839775 | 4/1970 | Canada . |
| 1100239 | 4/1981 | Canada . |
| 93/6935 | 4/1993 | WIPO . |

*Primary Examiner*—Thomas M. Lithgow
*Attorney, Agent, or Firm*—Rosenblatt & Redano, P.C.

[57] ABSTRACT

A process of separating at least one mineral, e.g. silica, from an aqueous medium, e.g. one containing iron ore, by froth flotation using cationic alkyloxyalkaneamine collectors free of acrylonitrile is described. Alkyloxyalkaneamines free of acrylonitrile may be made by reacting an alcohol with an alkenenitrile having at least 4 to 13 carbon atoms. This process produces branching on the third carbon from the nitrogen of the resulting compound, e.g. 3-hexoxypentaneamine. In addition to the absence of acrylonitrile, the alkyloxyalkaneamines give better selectivity than some conventional etheramines.

7 Claims, 1 Drawing Sheet

Flotation Test Flowsheet Used in Test Work

Flotation Test Flowsheet Used in Test Work

ALKYLOXYALKANEAMINES USEFUL AS CATIONIC FROTH FLOTATION COLLECTORS

FIELD OF THE INVENTION

The invention relates to cationic froth flotation collectors, and more particularly relates, in one embodiment, to cationic froth flotation collectors derived from ether amines.

BACKGROUND OF THE INVENTION

Flotation, and in particular, froth flotation is a physiochemical mineral concentration method that uses the natural and/or created differences in the hydrophobicity of the minerals to be separated. To enhance existing or to create new water repellancies on the surface of the minerals, certain heteropolar or nonpolar chemicals called collectors are added to the process. These reagents are designed to selectively attach to one or more of the minerals to be separated, forming a hydrophobic monolayer on their surfaces. This form makes the minerals more likely to attach to air bubbles upon collision. The combined air bubble/mineral particle mass is less dense than the displaced mass of the pulp, causing it to float to the surface, where they form a mineral-laden froth that can be skimmed off from the flotation unit, while the other minerals remain submerged in the pulp. The flotation of minerals with a negative surface charge, such as silica, silicates, feldspar, mica, clays, chrysocola, potash and others, from a pulp is achieved using cationic collectors. In iron and phosphate beneficiation processes, the impurities are floated away, leaving the valuable component behind. This process is called "reverse flotation". Cationic collectors are organic molecules that have a positive charge when in an aqueous environment. All cationic collectors have a nitrogen group with unpaired electrons present.

Three main categories of cationic collectors have found commercial application: fatty amines, ether amines and amine condensates. The fatty amines may be mono-functional or difunctional and the amine functionality may be primary, secondary or tertiary. Similarly, the ether amines may be primary amines or may be difunctional. An example of a condensate includes compounds such as $RCONHCH_2CH_2NHCH_2CH_2NHCOR$, and the like where R may be a straight or branched alkyl group of 6 to 22 carbon atoms.

In addition to the above-described amines, alkoxylated quaternary ammonium compounds and their salts have also been evaluated as cationic collectors.

These reagents may be applied either in neat form, particularly the ether amines and diamines, which are liquid at room temperature. The collectors may also be added in aqueous solution as the acid salt form.

Fatty amines are the product of ammonolysis of natural fats. This reaction produces primary amines with the carbon chain length associated with the various naturally occurring fats. The natural fats are essentially straight chain carbon linkages with varying degrees of unsaturation. The primary amines of chain length 16 and longer are poor surfactants and usually frothers must be added to make the process feasible. Some industries, such as those recovering phosphate and feldspar use custom-blended fatty primary amines with frothers and, occasionally, even emulsifying surfactants. This type of reagent not only incorporates the frothing characteristics of the frother, but also is a liquid product at lower temperatures, making it easier to handle.

If the fatty primary amine is reacted with acrylonitrile ($CH_2{=}CH{-}C{\equiv}N$), the fatty product is a fatty diamine. The presence of the second nitrogen group provides the diamine with added surfactancy, making the use of frothers unnecessary. Fatty secondary amines can be produced either as a reaction product of fatty alcohols and ammonia with the presence of a catalyst, or as a hydrogen reduction product of fatty primary amines with a catalyst. The reaction of additional fatty alcohol with the secondary amines using a catalyst produces fatty trialkyl tertiary amine.

If an alcohol is reacted with acrylonitrile, the result is an amine with an oxygen atom in the chain three carbons from the nitrogen. The presence of the oxygen atom (ether linkage) imparts a hydrophilic character to the otherwise hydrophobic chain. This results in an amine with more solubility and somewhat weaker collecting properties than the fatty amines. A second contact of the ether amine with acrylonitrile forms an ether diamine.

An amine condensate is the product of the reaction of a polyamine with an organic acid. The polyamines are generally short chain length compounds with three or more nitrogen atoms in the chain. The organic acid is usually, due to its favorable economics, tall oil.

A number of patents are known in this art. For example, Canadian Patent No. 796,803 describes a froth flotation process for separating silica from an ore, which concerns frothing the ore in the presence of an aqueous medium containing an acid salt of a primary aliphatic ether amine having the general formula $R{-}O{-}R'{-}NH_2$, where R is an aliphatic radical having 6 to 22 carbon atoms and R' is an alkylene radical having 2 to 6 carbon atoms. It is noted that the ether amines may be prepared by known methods of cyanoethylation (defined in chemical dictionaries as providing a $-OCH_2CH_2CN$ group by reaction with acrylonitrile) of a primary aliphatic alcohol, or mixtures of such alcohols, including oxo alcohols, to prepare the corresponding ether nitriles and then hydrogenating the latter to prepare the corresponding ether amines. If the cyanoethylation uses acrylonitrile, then R' must be $-CH_2CH_2CH_2-$, propyl, as is indeed the case for nearly all of the amines listed in this patent.

A froth flotation process for separating silica from an ore, which involves frothing the ore in the presence of an aqueous medium containing a water dispersable acid salt of an aliphatic ether diamine having the general formula $$R{-}O{-}CH_2CH(R'')CH_2NHCH_2CH(R'')CH_2{-}NH_2$$

where R is an aliphatic radical having 1–13 carbon atoms, and R" is a hydrogen atom or a methyl group and floating off the silica from the ore, is set out in U.S. Pat. No. 3,363,758 (which corresponds to Canadian Patent No. 839,775). The ether diamines of this patent are prepared by reacting an aliphatic ether primary amine with acrylonitrile or methacrylonitrile and then hydrogenating the resulting aliphatic ether amine nitrile to produce the ether diamine.

U.S. Pat. No. 4,319,987 describes the use of primary aliphatic ether amines as silica collectors in the concentration of minerals by the froth flotation process. More specifically, the use of mixtures of primary methyl branched aliphatic ether amines and the partially-neutralized salts thereof as flotation reagents is presented. In a further aspect, the use of mixtures of 3-isooctoxypropyl monoamine and 3-isodecoxypropyl monoamine and/or the partially-neutralized acetate salts thereof as collectors for silica in the beneficiation of oxidized taconite ores is mentioned. The patent teaches that the mixtures of methyl-branched alkyl ether amine acetates are prepared from the corresponding methyl-branched, preferably oxo, alcohols or mixtures of alcohols by the "well-known" cyanoethylation reaction, subsequent catalytic reduction, and neutralization with the conjugate acid of the desired anion. As noted previously, cyanoethylation requires acrylonitrile as a coreactant.

Acrylonitrile, used during the manufacture of the diamines and etheramines of the collectors described above, is extremely poisonous, making it dangerous for the workers during the synthesis of the collectors. Further, any residual, nonconverted acrylonitrile can be harmful to the environment, especially to the fish that come in contact with the waste streams of the beneficiation plants. Certain iron flotation plants in Canada have been closed due to the possibility of decimating their fish industry in the region.

It would thus be desirable if effective alkyloxyalkaneamine collectors could be developed which are free of acrylonitrile, but with no loss of activity.

SUMMARY OF THE INVENTION

Accordingly, it is an object of the present invention to provide a cationic alkyloxyalkaneamine compound useful in the froth flotation of minerals.

It is another object of the present invention to provide a method for selective froth flotation of minerals using a cationic alkyloxyalkaneamine collector that is essentially free of acrylonitrile.

It is yet another object of the invention to provide a method for selective froth flotation of minerals using an alkyloxyalkaneamine cationic collector having a relative low freeze point, relatively low viscosity and which is soluble in water.

In carrying out these and other objects of the invention, there is provided, in one form, a process of separating at least one mineral from an aqueous medium containing the mineral by froth flotation involving floating the mineral in the presence of an alkyloxyalkaneamine or an alkyloxyalkaneamine cationic collector which is an acid salt of an alkyloxyalkaneamine, where the alkyloxyalkaneamine is free of acrylonitrile.

DETAILED DESCRIPTION OF THE INVENTION

Figure 1:
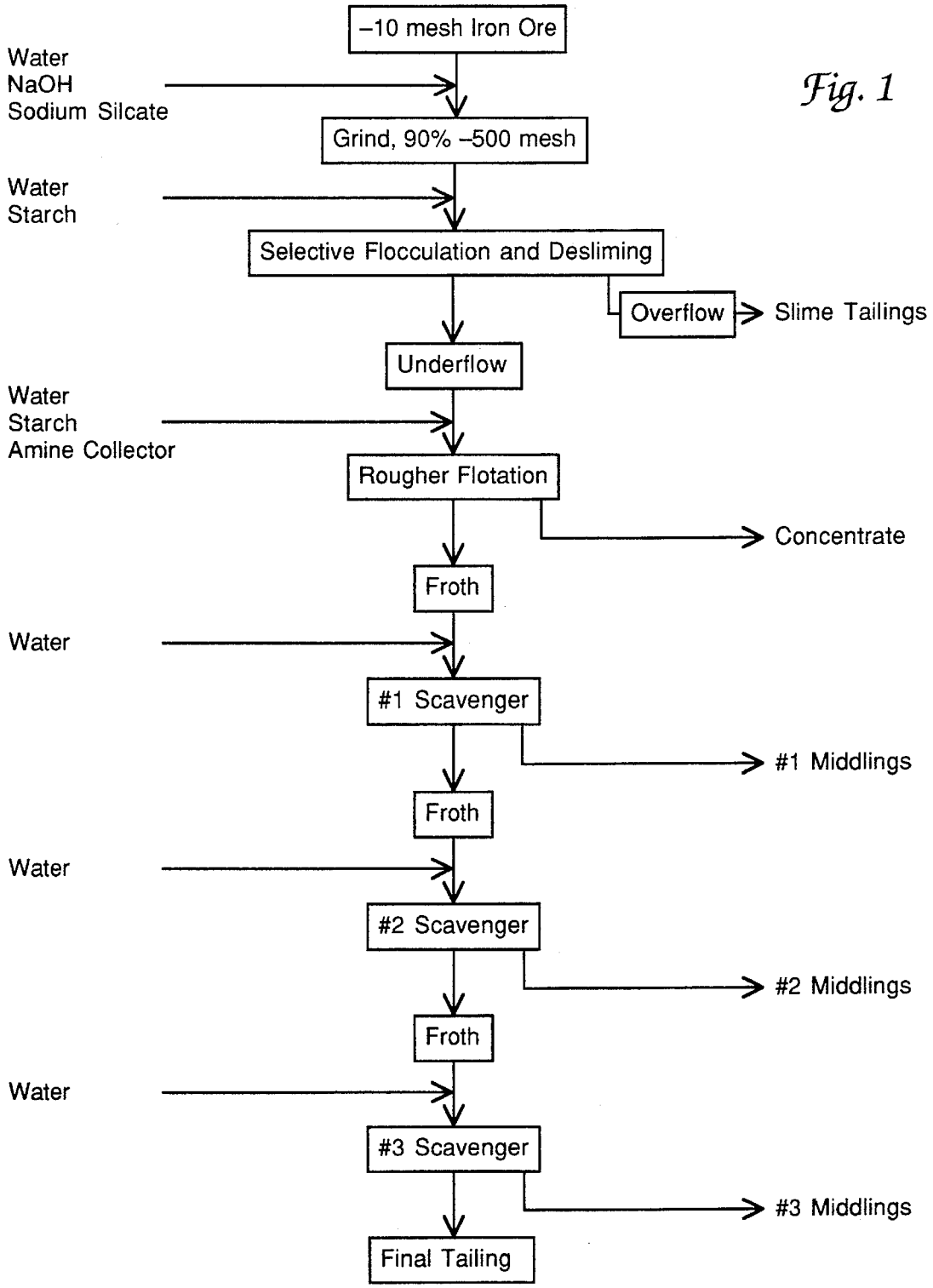
FIG. 1 is a flow diagram of the flotation test used to evaluate the cationic alkyloxyalkaneamine collectors of the invention.

It has been discovered that alkyloxyalkaneamines, and in particular 3-alkyloxypentaneamines may be made by first cyanoalkylating alcohols with alkenenitriles other than acrylonitrile (e.g. cis-2-pentenenitrile) and then hydrogenating the alkyloxyalkanenitrile intermediates (e.g. 3-alkylpentanenitrile) using known techniques.

Preferably, the alkenenitrile used to react with the alcohols have the structure:

$$R''—CH{=}CHC{\equiv}N$$

where R" is an alkyl group of at least one carbon atom and may include, but not necessarily be limited to a straight or branched alkyl group having an average of 1–10 carbon atoms. In one embodiment of the invention, the R" group has 2 carbon atoms (ethyl) so that the alkenenitrile is cis-2-pentenenitrile.

Reaction of the alkenenitrile with an alcohol of the formula R—OH, where R is a straight or branched alkyl group having an average of about 3 to 15 carbon atoms, gives an alkyloxyalkanenitrile intermediate:

$$R—O—R'''—C{\equiv}N$$

where R'" is a straight or branched divalent alkylene moiety having an average of about 2 to 14 carbon atoms. Hydrogenation by conventional techniques gives alkyloxyalkaneamines of the formula:

$$R—O—R'—NH_2$$

where R is a straight or branched alkyl group having an average of about 3 to 15 carbon atoms and where R' is a straight or branched divalent alkylene moiety having an average of about 4 to 8 carbon atoms. Preferably, R' is a branched divalent moiety, and in another embodiment, R' has an average of five carbon atoms.

In another embodiment of the invention, R' is branched at the 3 position, that is, it has the structure:

$$R—O—\underset{}{\overset{R^4}{\overset{|}{C}}}HCH_2CH_2—NH_2$$

where $R^4$ is a straight or branched alkyl group having an average of 1 to 5 carbon atoms. In one preferred embodiment, $R^4$ is ethyl, and the alkyloxyalkaneamine has the structure:

$$R—O—\overset{CH_2CH_3}{\overset{|}{C}}HCH_2CH_2—NH_2.$$

Specific examples of alkyloxyalkaneamines suitable in the practice of this invention include, but are not limited to, 3-butoxypentaneamine, 3-hexoxypentaneamine, and 3-(2-ethylhexoxy)pentaneamine. The alkyloxyalkaneamines can be, but need not be, distilled to produce a purer product.

The resulting alkyloxyalkaneamine is free of acrylonitrile. In another embodiment of the invention, the alkyloxyalkaneamine may also be (but not necessarily required to be) free of methacrylonitrile. Because of the toxicity of acrylonitrile, no amount should be present. Since most of the ether amines of this invention are in liquid form at room temperature, they may also be used neat, in addition to the acid salt form.

It will be appreciated that the level of treatment of a particular aqueous medium containing a mineral with the alkyloxyalkaneamine cationic collectors of this invention to remove the mineral cannot be predicted with accuracy. A large number of factors must be taken into consideration, including, but not limited to, concentration of the mineral or ores, presence of other minerals or ores, effectiveness of the collector, temperature and equipment used in the froth flotation process, etc. Within these parameters, a treatment rate of between about 0.01 and 1.0 lb/t, i.e. pound of collector per ton of ore, preferably at least about 0.2 lb/t may be used. In the case where the aqueous medium contains iron and silica, and the alkyloxyalkaneamine cationic collector aids in the froth flotation of the silica, it is expected in one embodiment to have a selectivity compared to conventional collectors.

The low temperature used in the manufacturing of the alkyloxyalkaneamines allows for the use of short chain alcohols. Good yields (above 90%) were obtained using butanol, 2-ethylhexanol and hexanol in laboratory preparation of the amines. The lower chain length of the hydrophobic portion of the molecule has a number of advantages. First, the selectivity of the collector is improved during the froth flotation process. In the reverse flotation technique of iron, where silica and silicate impurities are being floated away, selectivity is almost synonymous with recovery, that is, more iron will remain behind at equal concentrate grades. Second, it is expected that the freeze point of the collector, as well as its viscosity at temperatures of interest will be lower than conventional materials, which will make its handling easier.

Of course, a great advantage of the cationic collectors of this invention is thank they contain no residual acrylonitrile. While they may contain residual amounts of the higher alkenenitriles, e.g. cis-2-pentenenitrile, such materials are less toxic, and thus much less objectionable than acrylonitrile.

The invention will be further illustrated by the following Examples which are not meant to limit the inventive method, but only to further illuminate it.

Collectors Tested

The following cationic alkyloxyalkaneamine collectors were tested using the procedure illustrated in FIG. 1:

| | |
|---|---|
| X-176 | Acetate salt of 3-butoxypentaneamine, made by hydrogenating the product of cyanobutylation of 1-butanol with cis-2-pentenenitrile and KOH. |
| X-182 | Acetate salt of 3-hexoxypentaneamine, made by hydrogenating the product of cyanobutylation of 1-ethylhexanol with cis-2-pentenenitrile and KOH. |
| X-183 | Acetate salt of 3-(2-ethylhexoxy)pentaneamine, made by hydrogenating the product of cyanobutylation of 1-hexanol with cis-2-pentenenitrile and KOH. |
| Arosurf MG-98 | A comparative, commercially available ether propyl amine manufactured by reacting acrylonitrile with a $C_8$—$C_{10}$ branched aliphatic alcohol. Arosurf MG-98 is made by Sherex. |

Table I summarizes the first set of test results obtained according to the Flotation Test Flowsheet of FIG. 1. The most significant data for comparison between the tests is the percent iron recovery at 65 percent iron grade. This number is determined by plotting the cumulative iron recovery vs. the cumulative iron grade and reading the recovery at 65% iron grade from the plot. The recoveries are compared at 65% iron grade because this represents the minimum iron concentration that will normally yield the desired silica content in Ore A concentrates. In addition, approximate comparisons between tests can be made by examining the cumulative grade and recovery after each scavenger concentrate. This data is shown in Table II for Examples 1–10.

TABLE I

| Iron Recovery at 65% Iron Concentrate Grade | | | | |
|---|---|---|---|---|
| Ex. | Reagent | lb/t | Rec at 65% Fe | Remarks |
| 1 | MG-98 | 0.36 | 72.0 | |
| 2 | X-182 | 1.26 | 75.75 | |

TABLE I-continued

| Iron Recovery at 65% Iron Concentrate Grade | | | | |
|---|---|---|---|---|
| Ex. | Reagent | lb/t | Rec at 65% Fe | Remarks |
| 3 | X-183 | 1.26 | 70.5 | |
| 4 | X-182 | 1.01 | 75.5 | |
| 5 | MG-98 | 0.36 | 67.75 | |
| 6 | X-182 | 0.36 | 67.75 | |
| 7 | MG-98 | 0.36 | 70.25 | |
| 8 | MG-98 | 0.45 | 73.75 | |
| 9 | X-182 | 0.36 | 77.00 | Staged Collector Addition |
| 10 | X-182 | 0.45 | 78.00 | Staged Collector Addition |

Three tests using Arosurf MG-98 under standard test conditions produced recoveries of 70% in average at 65% iron grade (Examples 1, 5 and 7). When the test conditions were modified by increasing the collector level to 0.45 from 0.36 pounds per ton (lb/t), recovery at 65% grade was 73.8% (Example 8).

The amines of this invention, X-182 and X-183, were first tested at a high dosage rate of 1.26 lb/t so as to determine early in the program the merit of these two collectors. The X-182 amine performed quite well and yielded a 75.8 percent iron recovery at 65% concentrate grade (Example 2). A second test was run with X-182 at 1.01 lb/t to determine if this was close to the optimum collector level. The recovery at an iron grade of 75.5% (Example 4) was very near the previous test with X-182 (Example 2), which suggested that the collector could possibly be reduced by a substantial amount. The third test (Example 6) with X-182 was run at 0.36 lb/t, the rate that had been established as optimum for Arosurf MG-98. At this level of X-182, test results indicated a recovery of 67.8%, equal to the lowest MG-98 recovery, but below the highest recovery achieved with MGo98.

Visual observations during Example 6 and assay of the individual concentrates indicated that this collector produced a high concentrate grade in the rougher stage, but that it did not have the "staying power" to continue refloating silica in the later scavenger steps. Based on these observations it was decided to run two additional X-182 tests and make a second addition of collector to the 1st scavenger flotation step. Example 9 at 0.36 lb/t and Example 10 at 0.45 lb/t produced recoveries at grade of 77.0 and 78.0%, respectively. These tests indicate that with stage addition of 25% of the total collector to the first scavenger, recoveries for the X-192 collector were 4.2 to 5.0% higher than the highest MG-98 recovery at equal collector levels.

TABLE II

| Cumulative Grade & Recovery Data | | | | | | | | | | |
|---|---|---|---|---|---|---|---|---|---|---|
| | | | Rougher Conc. | | 1st Scavenger | | 2nd Scavenger | | 3rd Scavenger | |
| Ex. | Reagent | lb/t | Grade | Rec. | Grade | Rec. | Grade | Rec. | Grade | Rec. |
| 1 | MG-98 | 0.36 | 68.07 | 49.52 | 66.11 | 66.69 | 63.99 | 76.08 | 60.81 | 82.91 |
| 2 | X-182 | 1.26 | 66.83 | 52.25 | 65.92 | 70.86 | 63.64 | 80.70 | 57.74 | 88.64 |
| 3 | X-183 | 1.26 | 66.73 | 47.27 | 65.71 | 66.50 | 63.79 | 75.81 | 61.23 | 81.97 |
| 4 | X-182 | 1.01 | 66.57 | 49.91 | 66.35 | 68.27 | 64.42 | 77.85 | 57.11 | 87.78 |
| 5 | MG-98 | 0.36 | 66.49 | 52.04 | 64.30 | 71.44 | 60.33 | 82.03 | 55.12 | 89.51 |
| 6 | X-182 | 0.36 | 66.97 | 47.58 | 65.02 | 68.04 | 56.74 | 84.66 | 48.03 | 93.84 |
| 7 | MG-98 | 0.36 | 68.05 | 44.45 | 65.76 | 67.96 | 60.44 | 78.84 | 56.38 | 86.95 |
| 8 | MG-98 | 0.45 | 68.154 | 43.54 | 67.23 | 64.25 | 64.45 | 77.13 | 60.86 | 85.81 |
| 9 | X-182 | 0.36 | 66.91 | 59.99 | 65.71 | 75.15 | 59.29 | 86.83 | 48.23 | 94.29 |
| 10 | X-182 | 0.45 | 66.41 | 59.92 | 65.77 | 74.32 | 62.57 | 84.28 | 50.03 | 93.58 |

Additional tests are reported in Table III. Four examples from Table I were repeated. They included Examples 7 and 8 with MG-98 under standard conditions and tests 9 and 10 with X-182 in which the amine was stage added. Each amine was tested at two different dosage rates. Test 17 with MG-98 at 0.36 lb/t was repeated three times. The recoveries at 65% iron grade were 75.1%, 75.8% and 79.2% for tests 11, 12, and 13, respectively. The average recovery for the three tests was 76.7%. High recovery experienced in Example 13 was probably the result of an unusually efficient desliming operation in which higher than normal slime weight was removed at lower than normal iron content.

The repeats of Examples 9 and 10 with X-182 were rerun as Examples 19 and 20. Recoveries at grade for dosage rates of 0.35 and 0.45 lb/t were 79.2% and 81.2% respectively. These tests were run using stage addition of the amine to the rougher and 1st scavenger as in the previous tests. To gauge the effect of stage addition of MG-98, two tests, Examples 15 and 16, were run with the same addition points as in the X-182 tests. The recoveries at 65% grade were 72.5% and 78.5% for 0.33 and 0.45 lb/t, respectively.

TABLE III

| | Iron Recovery at 65% Iron Concentrate Grade | | | | |
|---|---|---|---|---|---|
| Ex. | Reagent | lb/t | Ore Type | Rec. at 65% Fe | Remarks |
| 11 | MG-98 | 0.36 | Ore A | 75.1 | |
| 12 | MG-98 | 0.36 | Ore A | 75.8 | |
| 13 | MG-98 | 0.36 | Ore A | 79.2 | |
| 14 | MG-98 | 0.45 | Ore A | 77.7 | |
| 15 | MG-98 | 0.33 | Ore A | 72.5 | Stage Addition Collector |
| 16 | MG-98 | 0.45 | Ore A | 78.5 | Stage Addition Collector |
| 17 | X-182 | 0.36 | Ore A | 79.5 | |
| 18 | X-182 | 0.45 | Ore A | 77.5 | |
| 19 | X-182 | 0.35 | Ore A | 79.2 | Stage Addition Collector |
| 20 | X-182 | 0.45 | Ore A | 81.8 | Stage Addition Collector |
| 21 | X-183 | 0.35 | Ore A | 73.8 | Stage Addition Collector |
| 22 | X-183 | 0.45 | Ore A | 73.5 | Stage Addition Collector |
| 23 | X-183 | 0.55 | Ore A | N.A. | Stage Addition Collector |
| 24 | MG-98 | 0.35 | Ore B | 80.8 | |
| 25 | MG-98 | 0.45 | Ore B | 81.2 | |
| 26 | X-182 | 0.35 | Ore B | 81.0 | |
| 27 | X-182 | 0.45 | Ore B | 85.5 | |

Three tests were run with X-183 to determine if stage addition would improve the metallurgy with this experimental amine. Dosage rates of 0.35 and 0.45 produced recoveries at 65% Fe grade of 73.8% (Example 21) and 73.5% (Example 22), respectively. Example 23 at 0.55 lb/t did not achieve a 65% Fe grade in any products.

Two additional tests with X-182 were tried without stage addition to see if the performance would be better under the slightly different water conditions experienced during this test series. Examples 9 and 10 from the above-described series were repeated as Examples 17 and 18, respectively, except that the amine was not stage added. The recoveries at 65% Fe grade were 79.5% and 77.5% at 0.36 and 0.45 lb/t, respectively.

A new, more recent ore type was obtained from a North American iron beneficiation plant. The new sample was designated "Ore B", and was tested on both MG-98 and X-182 without stage addition. At a dosage rate of 0.35 lb/t, the recovery at 65% Fe grade was 80.8% (Example 24) and 81.0% (Example 26) for MG-98 and X-182, respectively. When the dosage was increased to 0.45 lb/t, the recoveries were 81.2% (Example 25) and 85.5% (Example 27) for MG-98 and X-182, respectively.

TABLE IV

| | | | Ore | Rougher Conc. | | 1st Scavenger | | 2nd Scavenger | | 3rd Scavenger | |
|---|---|---|---|---|---|---|---|---|---|---|---|
| Ex. | Reag. | lb/t | Type | Grade | Rec. | Grade | Rec. | Grade | Rec. | Grade | Rec. |
| 11 | MG-98 | 0.36 | A | 67.37 | 49.36 | 66.54 | 65.63 | 64.88 | 75.48 | 62.14 | 83.09 |
| 12 | MG-98 | 0.36 | A | 67.62 | 50.51 | 66.31 | 67.44 | 64.82 | 76.47 | 62.45 | 82.95 |
| 13 | MG-98 | 0.36 | A | 68.73 | 51.79 | 67.16 | 69.66 | 65.26 | 78.50 | 62.14 | 85.11 |
| 14 | MG-98 | 0.45 | A | 67.74 | 54.52 | 66.54 | 71.26 | 63.74 | 80.45 | 60.53 | 86.33 |
| 15 | MG-98 | 0.33 | A | 66.63 | 60.73 | 65.80 | 74.60 | 63.69 | 81.84 | 60.12 | 87.48 |
| 16 | MG-98 | 0.45 | A | 66.78 | 57.76 | 66.20 | 72.47 | 64.48 | 79.96 | 61.08 | 85.83 |
| 17 | X-182 | 0.36 | A | 66.81 | 64.76 | 64.85 | 80.51 | 53.69 | 91.51 | 46.37 | 95.14 |
| 18 | X-182 | 0.45 | A | 66.36 | 63.64 | 64.16 | 80.77 | 54.32 | 92.02 | 45.54 | 96.30 |
| 19 | X-182 | 0.35 | A | 67.23 | 52.61 | 66.80 | 65.82 | 66.20 | 73.1 | 64.32 | 80.27 |
| 20 | X-182 | 0.45 | A | 67.84 | 54.60 | 67.63 | 67.98 | 66.23 | 76.36 | 63.83 | 83.45 |
| 21 | X-183 | 0.35 | A | 65.49 | 61.82 | 64.52 | 76.22 | 62.5 | 83.13 | 58.59 | 88.26 |
| 22 | X-183 | 0.45 | A | 65.87 | 61.96 | 64.62 | 75.99 | 62.81 | 82.62 | 59.71 | 87.43 |
| 23 | X-183 | 0.55 | A | 63.10 | 65.68 | 62.35 | 79.54 | 60.97 | 85.56 | 57.91 | 88.09 |
| 24 | MG-98 | 0.35 | B | 67.45 | 55.75 | 66.68 | 72.47 | 65.06 | 80.84 | 62.31 | 86.62 |

TABLE IV-continued

| | | | Ore | Rougher Conc. | | 1st Scavenger | | 2nd Scavenger | | 3rd Scavenger | |
|---|---|---|---|---|---|---|---|---|---|---|---|
| Ex. | Reag. | lb/t | Type | Grade | Rec. | Grade | Rec. | Grade | Rec. | Grade | Rec. |
| 25 | MG-98 | 0.45 | B | 67.46 | 54.38 | 66.84 | 71.11 | 65.47 | 79.80 | 62.70 | 85.93 |
| 26 | X-182 | 0.35 | B | 67.28 | 60.13 | 66.20 | 76.51 | 63.02 | 86.03 | 55.57 | 92.66 |
| 27 | X-182 | 0.45 | B | 67.81 | 57.51 | 67.6 | 73.53 | 66.54 | 81.35 | 64.26 | 87.05 |

From Examples 11–27 a number of conclusions may be drawn. 3-Hexoxypentaneamine (X-182) provides clearly superior metallurgy. The best MG-98 average result on Ore A was Example 16 where the dosage rate was 0.45 lb/t and the amine was stage added. The recovery at 65% Fe grade was 78.5%. The best result on Ore A with X-182 was Example 20 with 0.45 lb/t of amine stage added to produce a recovery at 65% Fe grade of 81.8%. The 3-hexoxypentaneamine (X-182) of this invention was also preferable to MG-98 on "Ore B" ore at a dosage rate of 0.45 lb/t. Recovery at 65% Fe grade for MG-98 and X-182 was 81.2% and 85.5% for Examples 25 and 27, respectively.

In stage addition of the collector, at least 50% of the total collector proportion should be added in the first portion, preferably at least 70% is added in the first portion.

Another amine of this invention, 3-butoxypentaneamine (X-176) was tested as in Examples 1–10. The results are presented in Table V.

TABLE V

| | | | Cumulative Grade & Recovery Data | | | | | | | |
|---|---|---|---|---|---|---|---|---|---|---|
| | | | Rougher Conc. | | 1st Scavenger | | 2nd Scavenger | | 3rd Scavenger | |
| Ex. | Reagent | lb/t | Grade | Rec. | Grade | Rec. | Grade | Rec. | Grade | Rec. |
| 28 | X-176 | 0.51 | 57.63 | 57.37 | 47.49 | 80.65 | 41.36 | 95.12 | 41.36 | 95.12 |
| 29 | X-176 | 0.75 | 63.72 | 60.23 | 57.01 | 79.32 | 44.31 | 94.20 | 44.31 | 94.20 |
| 30 | X-176 | 1.26 | 65.15 | 57.95 | 60.95 | 75.47 | 48.02 | 90.83 | 44.05 | 96.48 |

Many modifications may be made in the present invention without departing from the spirit and scope thereof which are defined only by the appended claims. For example, alkyloxyalkaneamines which are not explicitly exemplified herein, but which nevertheless fall within the general definition thereof and which are made without acrylonitrile are expected to find utility. It is anticipated, as one of ordinary skill in the art can appreciate, that certain of the alkyloxyalkaneamines of this invention will need to be matched with certain minerals or ores to be recovered in an empirical manner which cannot be predicted. For example, it is expected that the alkyloxyalkaneamines of this invention would be useful in the selective extraction of silica sand from low-grade phosphate ore.

We claim:

1. A process of separating at least one mineral from an aqueous medium containing the mineral by froth flotation comprising floating the mineral in the presence of a collector selected from the group consisting of an alkyloxyalkaneamine and an alkyloxyalkaneamine cationic collector which is an acid salt of an alkyloxyalkaneamine, where the alkyloxyalkaneamine is free of acrylonitrile, and where the alkyloxyalkaneamine is a 3-alkyloxypentaneamine having the formula:

$$R-O-\underset{}{\overset{CH_2CH_3}{\overset{|}{C}}}HCH_2CH_2-NH_2$$

where R is a straight or branched alkyl group having an average of about 3 to 15 carbon atoms.

2. The process of claim 1 where the alkyloxyalkaneamine is selected from the group consisting of 3-butoxypentaneamine, 3-hexoxypentaneamine, and 3-(2-ethylhexoxy)pentaneamine.

3. The process of claim 1 where the aqueous medium contains particles of iron and silica minerals and the collector aids in the froth flotation of the particles of silica minerals at an improved selectivity over the particles of iron minerals compared to ether amine collectors made by reacting acrylonitrile with $C_8$–$C_{10}$ branched aliphatic alcohol.

4. A process of separating at least one mineral from an aqueous medium containing the mineral by froth flotation comprising floating the mineral in the presence of a collector selected from the group consisting of an alkyloxyalkaneamine and an alkyloxyalkaneamine cationic collector which is an acid salt of an alkyloxyalkaneamine, where the alkyloxyalkaneamine is made by a method in the absence of acrylonitrile and which is a 3-alkyloxypentaneamine having the formula:

$$R-O-\underset{}{\overset{CH_2CH_3}{\overset{|}{C}}}HCH_2CH_2-NH_2$$

where R is a straight or branched alkyl group having an average of about 3 to 15 carbon atoms.

5. The process of claim 4 where the alkyloxyalkaneamine is selected from the group consisting of 3-butoxypentaneamine, 3-hexoxypentaneamine, and 3-(2-ethylhexoxy)pentaneamine.

6. The process of claim 4 where the aqueous medium contains particles of iron and silica minerals and the collector aids in the froth flotation of the particles of silica minerals at an improved selectivity over the particles of iron minerals compared to ether amine collectors made by reacting acrylonitrile with $C_8$–$C_{10}$ branched aliphatic alcohol.

7. A process of separating silica from iron in an aqueous medium containing the silica and iron by froth flotation comprising floating the silica in the presence of a collector selected from the group consisting of an alkyloxyalkaneamine or an alkyloxyalkaneamine cationic collector which is an acid salt of an alkyloxyalkaneamine, where the alkyloxyalkaneamine is selected from the group consisting of 3-butoxypentaneamine, 3-hexoxypentaneamine, and 3-(2-ethylhexoxy)pentaneamine, where the alkyloxyalkaneamine is made by a method in the absence of acrylonitrile, and recovering the silica at an improved selectivity compared to ether amine collectors made by reacting acrylonitrile with $C_8$–$C_{10}$ branched aliphatic alcohol.

* * * * *